US005173686A

United States Patent [19]

Fujihara

[11] Patent Number: 5,173,686

[45] Date of Patent: Dec. 22, 1992

[54] SLIDING ACCOMMODATION TYPE LIQUID CRYSTAL DISPLAY DEVICE

[75] Inventor: Toshiharu Fujihara, Tokyo, Japan

[73] Assignee: Clarion Co., Ltd., Tokyo, Japan

[21] Appl. No.: 627,651

[22] Filed: Dec. 14, 1990

[30] Foreign Application Priority Data

Dec. 15, 1989 [JP] Japan ..... 1-326826

[51] Int. Cl.[5] ..... G09G 3/36

[52] U.S. Cl. ..... 340/700; 248/920

[58] Field of Search ..... 340/700, 784, 461; 364/708, 800; 361/380, 390, 391; 312/208, 323; 248/917, 923; 358/254; 200/52 A, 61.45 R, 61.46, 61.7, 61.62, 61.58 R, 58

[56] References Cited

U.S. PATENT DOCUMENTS

| | | | |
|---|---|---|---|
| 4,195,431 | 4/1980 | Neufield | 40/544 |
| 4,504,910 | 3/1985 | Araki et al. | 340/995 |
| 4,742,478 | 5/1988 | Nigero, Jr. et al. | 364/708 |
| 4,983,951 | 1/1991 | Igarashi et al. | 340/461 |
| 5,021,922 | 6/1991 | Davis et al. | 348/920 |

*Primary Examiner*—Alvin E. Oberley
*Assistant Examiner*—Amare Mengistu
*Attorney, Agent, or Firm*—Flynn, Thiel, Boutell & Tanis

[57] ABSTRACT

An apparatus has a liquid crystal display unit, which can be drawn out/accommodated by sliding with respect to a main body of the apparatus, and rotated in the state, where it is drawn out from the apparatus, in which apparatus operation is simplified by correlating switching on/off of the liquid crystal display and accommodating operation of the liquid crystal display unit with the rotation of the liquid crystal display unit.

7 Claims, 7 Drawing Sheets

SLIDING ACCOMMODATION TYPE LIQUID CRYSTAL DISPLAY DEVICE

FIELD OF THE INVENTION

The present invention relates to a liquid crystal display device and more in detail to a device having a liquid crystal display unit, which can be drawn out/accomodated by sliding it with respect to the main body of an apparatus and also rotated at a position, where it is drawn out completely.

BACKGROUND OF THE INVENTION

Recently the tendency to install a television set in the room of a vehicle to look on it has been rapidly raised. However it is difficult to install a CRT (cathode-ray tube) type television set in a very restricted space within the vehicle. Therefore it is thought that a liquid crystal television set, which occupies only a small space, is promising in the future, accompanied by the coloration and the improvement in the resolving power of the liquid crystal display device. Various types of liquid crystal television sets for use in vehicles have been proposed. Among them, the type, to which special attention is paid, is one, by which a unit including the liquid crystal display is accomodated by sliding it with respect to the main body of an apparatus, which is adopted by the present invention described later.

Although FIGS. 1 to 3 show embodiments of the present invention, they are identical in appearance to devices according to a prior art technique explained here. The basic operation at looking on a television set is effected by pushing at first an open/close switch to drive the liquid crystal display unit; waiting for the state where it is pushed out completely to the exterior, thereafter adjusting the liquid crystal display unit at a desired inclination angle; and finally manipulating the power switch of the tuner to drive the television set. When looking on of the television is terminated, the power switch of the tuner is turned off; the inclination is returned to the original position to realize the state where it can be received in the main body; and the open/close switch is pushed so that the liquid crystal display unit is pulled therein.

In this way, various sorts of switches are operated one after another at starting and terminating the use of the apparatus. However, when a device for use in a vehicle, for which this kind of devices is the most required, is considered, it is not desirable that the number of necessary operations of the switches is great. In the case where it is necessary for a driver himself to operate the switches during the drive for some reason, it is desirable to restrict the number of operations of the switches to a value as small as possible and this cannot be treated lightly for taking a measure for security. On the contrary, if a plurality of operations are linked with each other carelessly, the state of the apparatus proceeds to a state, which is not desired by the user, which is not desirable, too. From the point of view described above, it has been tried to decrease reasonably the number of operations without producing any inconveniences for the use thereof.

OBJECT OF THE INVENTION

The present invention has been done in order to remove the drawbacks of the prior art technique described above and to realize the simplification of the operation.

SUMMARY OF THE INVENTION

The present invention has two features described below.

At first, a sliding accomodation type liquid crystal display device according to the first feature is characterized in that it comprises a main body of an apparatus; a liquid crystal display unit disposed slidably between a position, where it is accomodated within the main body of the apparatus, and another position, where it is drawn out from the apparatus, and supported rotatably at the backside end thereof so as to be rotatable at the position, where it is drawn out from the apparatus; rotation detecting means for detecting whether it is in the state where it is rotated at the position, where it is drawn out from the apparatus, or not; and control means for controlling the apparatus so as to make the liquid crystal display unit display an image, when it is detected by the rotation detecting means that it is in the state where it is rotated.

A sliding accomodation type liquid crystal display device according to the second feature is characterized in that it comprises a main body of an apparatus; a liquid crystal display unit disposed slidably between a position, where it is accomodated within the main body of the apparatus, and another position, where it is drawn out from the apparatus, and supported rotatably at the backside end thereof so as to be rotatable downward and by some amount upward at the position, where it is drawn out from the apparatus; excessive rotation detecting means for detecting that it is rotated by some amount upward at the position, where it is drawn out from the apparatus; driving means for making the liquid crystal display unit effect sliding movement with respect to the main body of the apparatus; and control means for controlling the apparatus so as to accomodate the liquid crystal display unit in the main body of the apparatus, when a detection signal is received from the excessive rotation detecting means.

DETAILED DESCRIPTION

Figure 1:
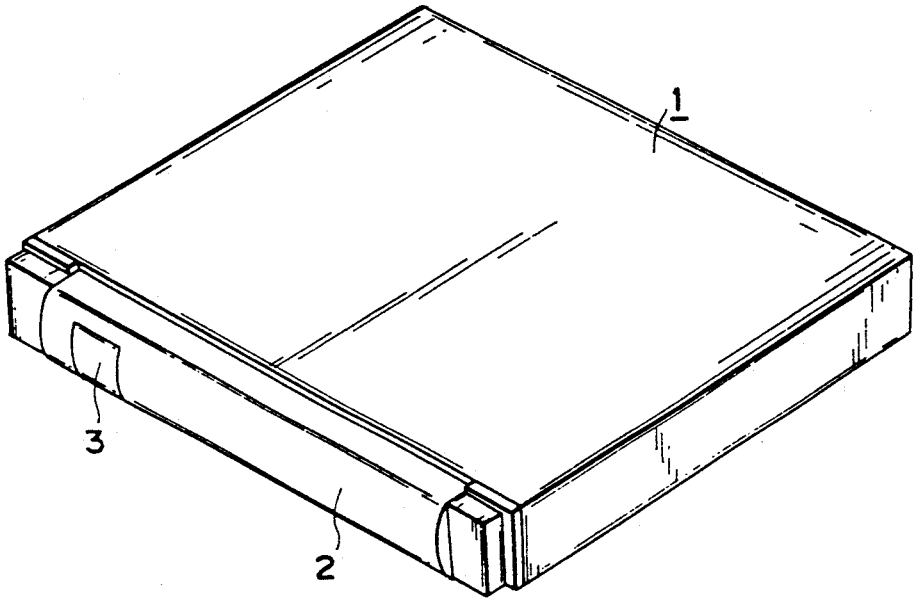
FIG. 1 is a perspective view showing a state of a liquid crystal display device, which is an object of the present invention, in which a liquid crystal display unit is accomodated therein.

FIG. 1 shows an embodiment of the liquid crystal display device utilizing the present invention, which is a device having a thickness of 25 mm, called ½ DIN side for use in vehicle. The extremity portion of a liquid crystal display unit 2 is exposed through an opening formed on the front side of the main body 1 of an apparatus. When an open/close switch 3*a* is pushed, a driving mechanism explained later is driven and the liquid crystal display unit 2 is slid forward so as to protrude outward from the main body of the apparatus.

Figure 2:
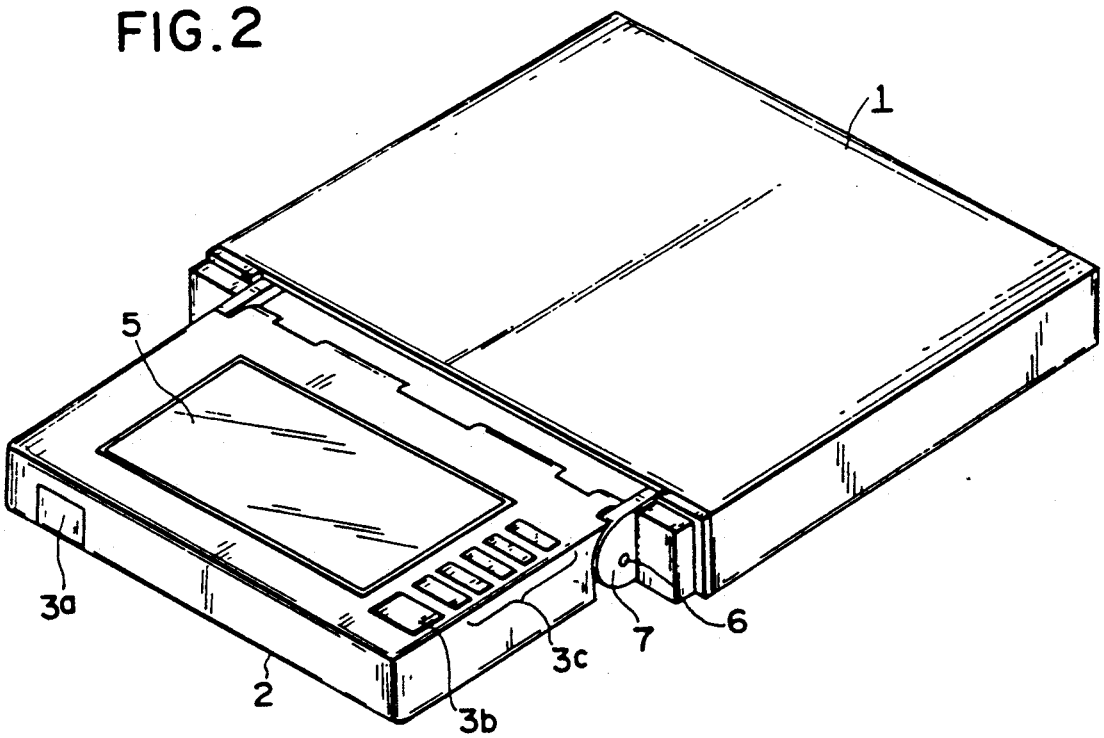
FIG. 2 is a perspective view showing a state of the liquid crystal display device, which is the object of the present invention, in which the liquid crystal display unit is drawn out therefrom.

FIG. 2 shows a state, where the liquid crystal display unit 2 is completely drawn out to the exterior, in which a liquid crystal image screen 5, a power switch 3*b* and other various sorts of switches 3*c* have come into view. The liquid crystal display unit 2 is supported a rotating fulcrum 6 with respect to a slide plate 7. In the state where the liquid crystal display unit 2 is drawn out completely from the main body 1 of the apparatus, as indicted in FIG. 2, it can be rotated downward so as to be adjusted at an angle, where the image screen can be easily looked on.

Figure 3:
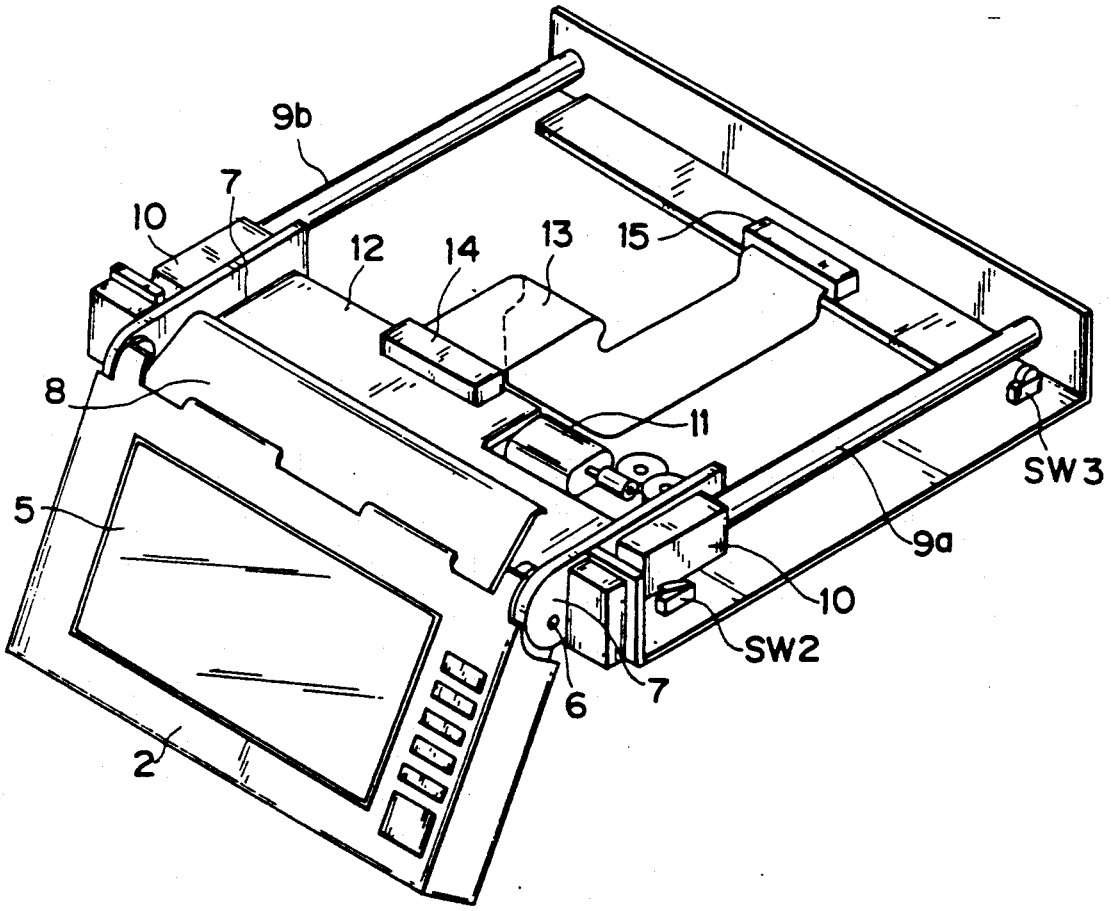
FIG. 3 is a perspective view showing a state of the liquid crystal display device, which is the object of the present invention, in which the liquid crystal display unit is rotated at a position, where it is drawn out therefrom.

FIG. 3 shows a state, where the liquid crystal display unit is rotated downward and the upper cover of the main body 1 of the apparatus is removed. A dust-proof shutter 8 is pivoted also in the neighborhood of the pivot portion of the liquid crystal display unit 2 and energized upward by a spring not shown in the figure so as to shut up the gap produced between the liquid crystal display unit 2 and the main body 1 of the apparatus, accompanied by the downward rotation of the former, and to protect the inner mechanism while preventing penetration of dust and foreign matter. Two guide shafts 9*a* and 9*b* are disposed fixedly in the back- and forward direction in the two side portions. Rack gear is formed on the inner side of the guide shaft 9*a*, although it is not seen in the figure. A holding block 10 is disposed fixedly on the outer side of each of the slide plates 7, surrounding the peripheral surface of each of the guide shafts 9*a* and 9*b* so as to be slidingly in contact therewith with such a width that the holding blocks don't shake. A connector 14 disposed on the backside of a base plate 12 is coupled with another connector 15 on the side of the main body of the apparatus through a flexible base plate 13. When driving force of a motor 11 is transmitted to the rack gear of the guide shaft 9*a* through a gear train, the sliding unit consisting of the slide plate 7, the holding blocks 10, the base plate 12, etc. begins to move. When this sliding unit arrives at the most advanced position, a front side switch SW2 is driven, while a rear side switch SW3 is driven, when it arrives at the most retreated position, so that it is detected where the sliding unit is.

Figure 4A:
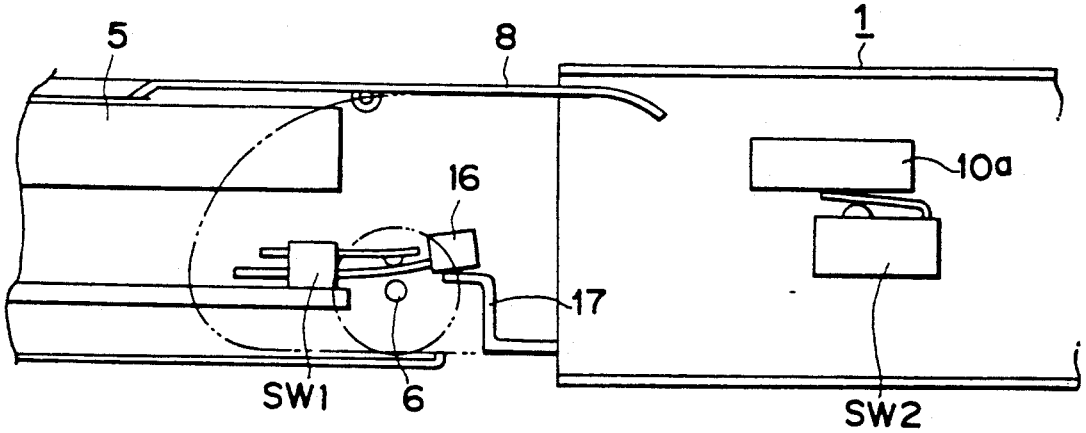
FIGS. 4A and 4B are schemes illustrating the construction of the principal part showing a first embodiment of a part, where the liquid crystal display unit of the liquid crystal display device according to the present invention is pivoted.
Figure 4B:
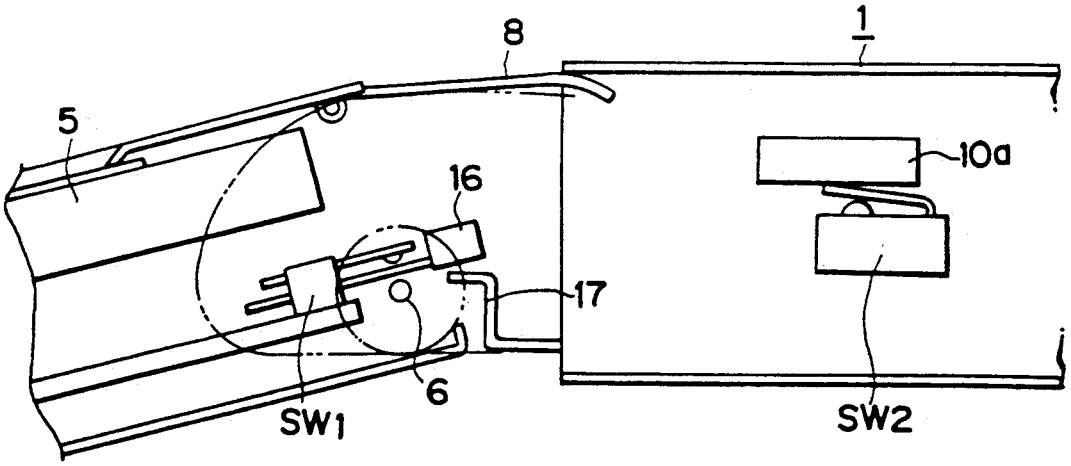
Figure 7:
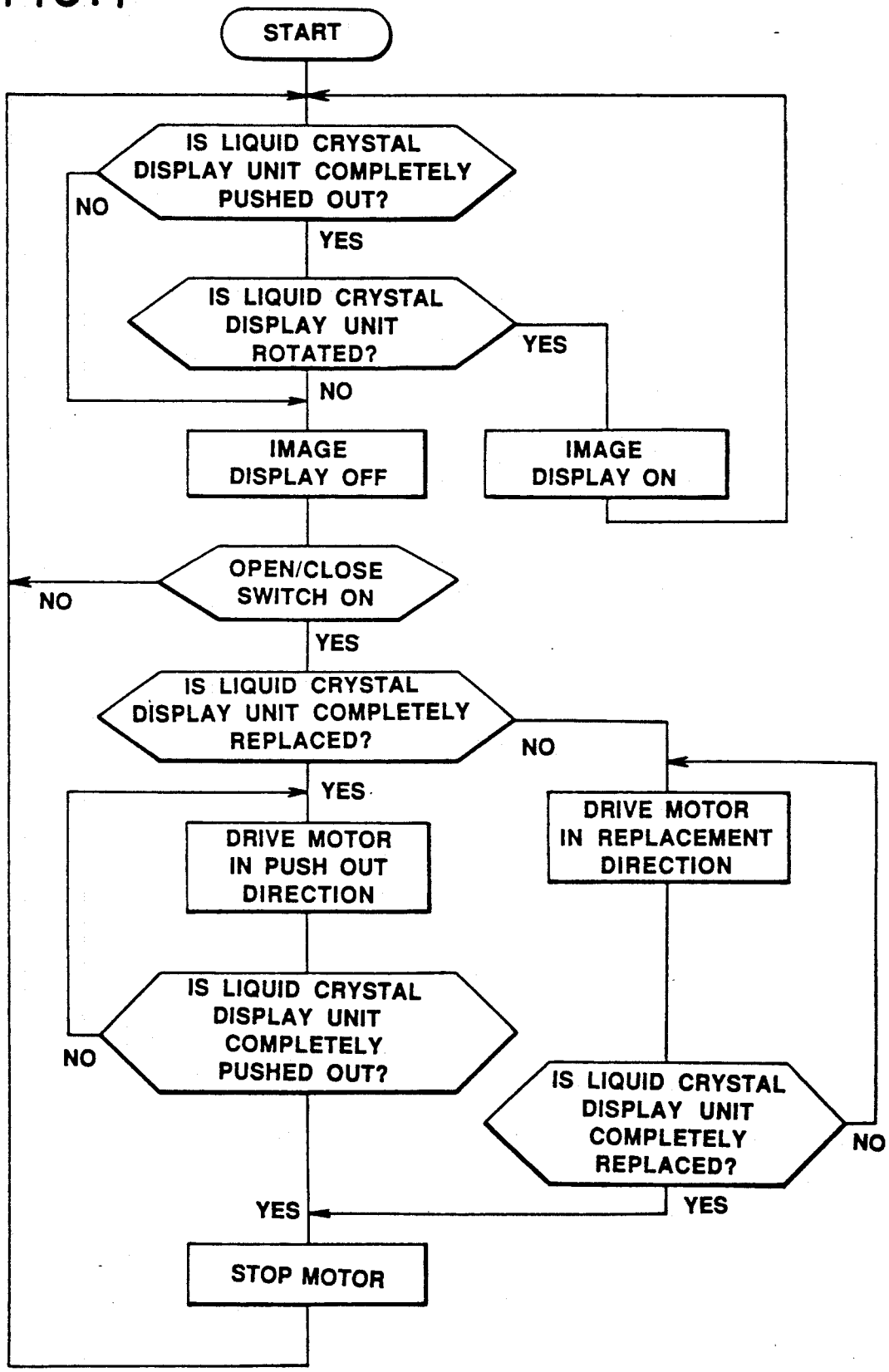
FIG. 7 is a flow chart indicating the operation of the first embodiment of the liquid crystal display device according to the present invention.

FIGS. 4A and 4B are cross-sectional views for explaining the first embodiment, concerning the operation of the device according to the present invention. Both the two figures show the state, where the liquid crystal display unit 2 is drawn out as far as possible. 10*a* is a switch actuating protrusion which protrudes from a side surface of one of the holding blocks 10, although it is not indicated in FIG. 3, which protrusion actuates the front side switch SW2 and the rear side switch SW3. FIG. 4A shows the state, where the liquid crystal display unit 2 is horizontal, i.e. where it is not rotated around the rotating fulcrum. In this state a contactor 16 is brought into contact with a limiting portion 17 by bending a part of the bottom plate of the sliding unit so that the contacts of a rotation detecting switch SW1 are in contact with each other. In this state, no image appears yet on the liquid crystal image screen 5. Then, when the liquid crystal display unit is rotated as indicated in FIG. 4B, the contactor 16 is separated from the limiting portion 17 and consequently the contacts of the rotation detecting switch SW1 are separated from each other. When the rotation of the liquid crystal display unit is detected in this way, the image display on the liquid crystal image screen 5 is effected. For example, if the main apparatus is a television set, the power source for the image display system including a tuner section and an amplifying section is turned-on. On the contrary, in the case where the liquid crystal display unit 2 is returned to its horizontal state, i.e. to the state indicated in FIG. 4A, the contacts of the rotation detecting switch 1 are brought into contact so that it is detected that the liquid crystal display unit has been made horizontal. Therefore the image display on the liquid crystal image screen 5 disappears. The reason why the rotating state of the liquid crystal display panel 2 and switching on/off of the image display are linked with each other in this way is that based on the action to bend the liquid crystal display unit 2 by rotating it, it can be judged that it is intended to start the use of the device and on the contrary, based on the action to return the liquid crystal display unit 2 to the horizontal state so that it can be accomodated in the main body 1 of the apparatus, it can be judged that the use of the device is terminated. The flow chart in FIG. 7 shows a series of operations including the accomodating and the pushing out operation of the liquid crystal display unit 2 and the rotating state thereof.

Figure 5A:
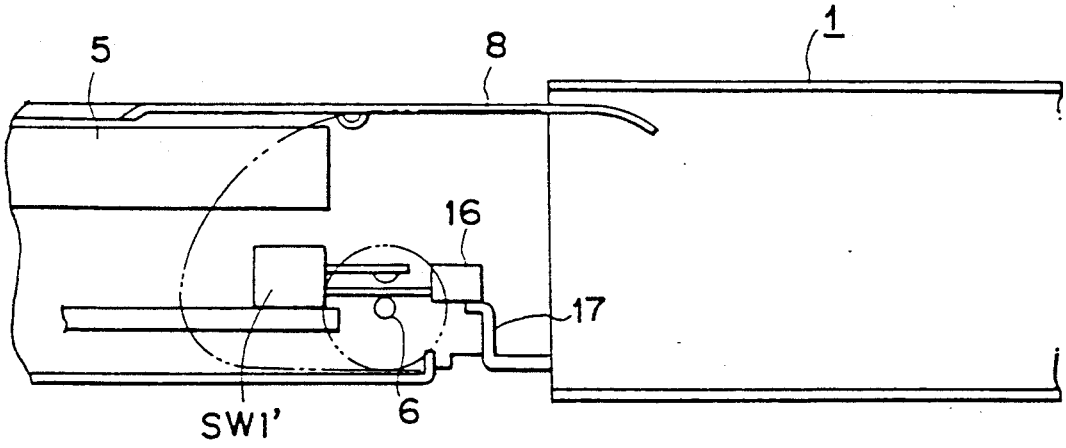
FIGS. 5A and 5B are schemes illustrating the construction of the principal part showing a second embodiment of the part, where the liquid crystal display unit of the liquid crystal display device according to the present invention is pivoted.
Figure 5B:
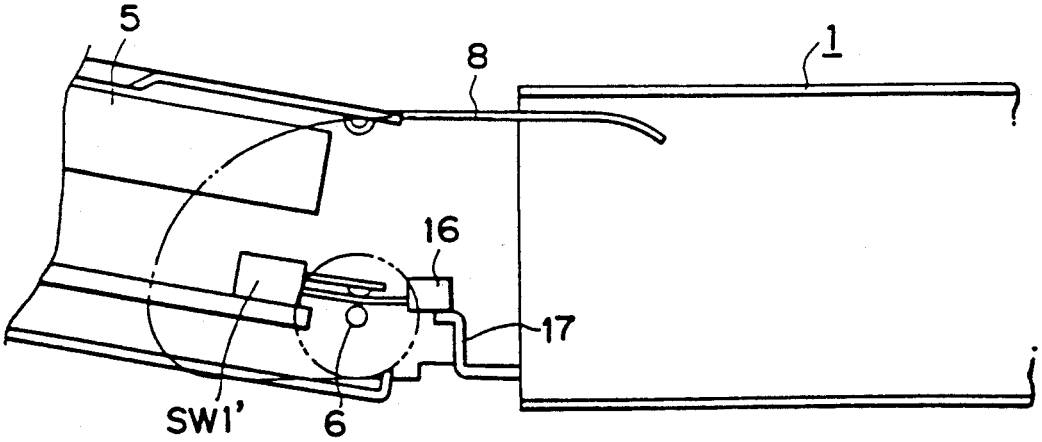
Figure 8:
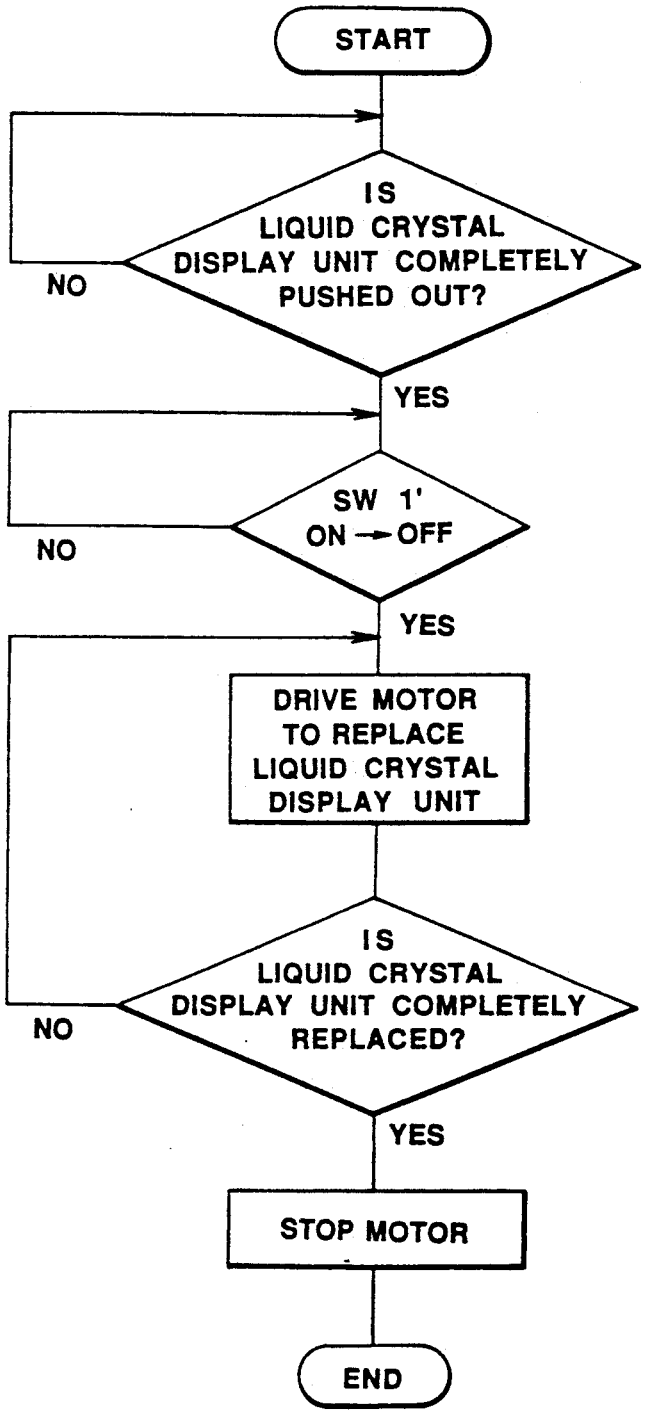
FIG. 8 is a flow chart indicating the operation of the second embodiment of the liquid crystal display device according to the present invention.

FIGS. 5A and 5B are cross-sectional views for explaining the second embodiment, concerning the operation of the device according to the present invention, which show the state, where the liquid crystal display unit 2 is drawn out as far as possible, similarly to FIGS. 4A and 4B. In FIG. 5A, the liquid crystal display unit 2 is in the horizontal state, in which the contactor is only slightly contacted with the limiting portion 17 and the contacts of the rotation detecting switch SW1' are not in contact with each other. FIG. 5B shows a state, where the liquid crystal display unit 2 is rotated upward by some amount. In this state, since the contactor 16 is brought into contact with the limiting portion 17 by a certain measure of force, the contacts of the rotation detecting switch SW1' are brought into contact with each other. In this way it is detected that the liquid crystal display unit 2 has been rotated upward from the horizontal position. When a hand, which has lifted up the liquid crystal display unit 2, is separated therefrom, it returns by the own weight to the state indicated in FIG. 5A so that the contacts of the rotation detecting switch SW1' are separated from each other. An instruction is issued by control means described later by detecting a signal variation at this point of time so that the liquid crystal display unit 2 is retreated towards the backside by the driving force of the motor 11. That is, the liquid crystal display unit 2 is accomodated within the main body 1 of the apparatus without operating the open/close switch 3*a*. This is because, based on the action to rotate the liquid crystal display unit 2 upward from the state, where it is rotated downward, so as to lift it up to the horizontal position, where it can be accomodated within the main body 1 of the apparatus, it can be judged that the use of this device is terminated. The flow chart indicated in FIG. 8 shows the operation of the present embodiment.

Figure 6:
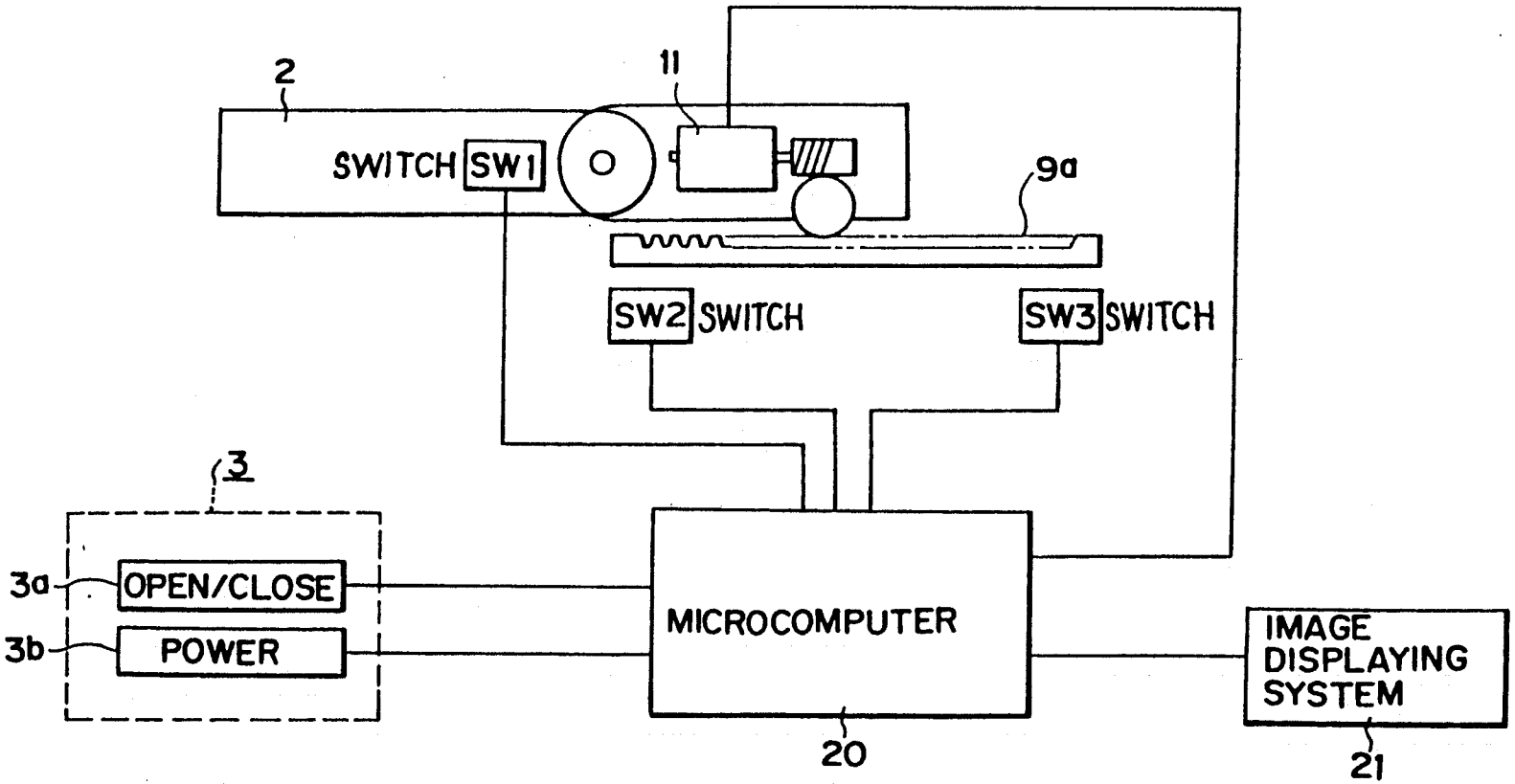
FIG. 6 is a block diagram indicating the principal system of the liquid crystal display device according to the present invention.

The signal system of the present invention will be explained by using the system chart indicated in FIG. 6. In the figure, SW1 represents the rotation detecting switch for detecting the rotational state of the liquid crystal display unit 2, corresponding to SW1' in the second embodiment explained, referring to FIGS. 5A and 5B. A microcomputer 20 receives signals from the front side detecting switch SW2, the rear side detecting switch SW3 and a group of various sorts of switches 3 apart from this rotation detecting switch 3 and controls the motor 11 and the image displaying system 21 such as a tuner, etc. The driving force of the motor 11 is transmitted to the guide shaft 9*a* through a gear train so that the liquid crystal display unit 2 is accomodated or pushed out in or from the main body of the apparatus. Although, in the first and the second embodiment, the characteristic part of the present invention has been explained that the switching on/off of the image displaying system and the drive of the motor 11 are controlled, linked with the accomodated or pushed out position and the rotational state of the liquid crystal display unit 2, the open/close switch 3*a* and the power switch 3*b* may be independently operated under a certain condition. For example, in conjunction with the first embodiment, although the image is displayed, when the liquid crystal display unit 2 is rotated so as to be in the bent state, if the power switch 3*b* is operated in this state, the image display may be switched off, remaining in the bent state. Further, on the contrary, even if the liquid crystal display unit 2 is not rotated, remaining in the pushed out state, the image display can be turned-on by operating the power switch 3*b*. On the other hand, in conjunction with the second embodiment, even if the liquid crystal display unit 2 is not rotated from the bent state to the horizontal state, the liquid crystal display unit 2 may be accomodated by operating the open/close switch 3*a*. However, in the case where the state, where the liquid crystal display unit 2 is bent, is detected by the rotation detecting switch SW1, even if the open/close switch 3*a* is operated, the liquid crystal unit 2 is not accomodated. This is because a protecting mechanism works in order to prevent damage of the driving system including the motor 11 and others, the case for the liquid crystal display unit 2, etc.

According to the present invention explained above, it is possible to reduce reasonably the number of necessary operations at pushing out the liquid crystal display unit of a sliding accomodation type liquid crystal display device from the main body of an apparatus to start the image display or at returning the liquid crystal display unit from the bent state to the horizontal state to accomodate it in the main body. Therefore this device is not only convenient for usual home use apparatuses, but also contributes remarkably in particular to reduction of danger during the drive of a vehicle, when it is used, mounted on the vehicle.

What is claimed is:

1. A sliding accommodation type liquid crystal display device comprising:

a main body of an apparatus;

a liquid crystal display unit supported slidably for movement between a first position where it is accommodated within said main body of the apparatus and a second where it is drawn out from said main body, and supported rotatably at a backside end thereof so as to be rotatable downward and by some amount upward with respect to said main body when in said second position where it is drawn out from said main body;

excessive rotation detecting means for generating a detection signal when said unit is rotated by some amount upward when in said second position where it is drawn out from said main body;

driving means for effecting sliding movement of said liquid crystal display unit from said second position to said first position with respect to said main body of the apparatus; and control means for causing said drive means to effect movement of said liquid crystal display unit from said second position to said first position with respect to said main body of the apparatus in response to said detection signal from said excessive rotation detecting means.

2. A device of claim 1, wherein said main body includes first and second spaced and parallel guide rods, and wherein said drive means includes first and second holding blocks each slidably supported on a respective one of said first and second guide rods, and first and second slide parts respectively fixedly secured to said first and second holding blocks, said slide parts supporting said liquid crystal display unit for said rotatable movement at said backside end thereof.

3. A device of claim 2, including a base plate extending between and fixedly secured to said slide parts, and wherein said drive means includes said first guide rod having a gear rack thereon, includes an electric motor and means supporting said motor on said base plate, and includes gear train means drivingly coupling said motor to said gear rack.

4. A device of claim 3, wherein said drive means includes first and second limit switches provided at spaced locations on said main body, and wherein said first holding block has a protrusion which respectively actuates said first and second limit switches when said liquid crystal display unit is respectively in said first and second positions, and means responsive to actuation of either of said first and second limit switches when said electric motor is running for stopping said electric motor.

5. A device of claim 4, including a first connector mounted on said base plate, a second connector mounted on said main body, and a flexible member extending between and coupled to each of said connectors.

6. A device of claim 1, wherein said backside end of said liquid crystal display unit is spaced outwardly from said main body when said liquid crystal display unit is in said second position; including a dust shutter pivotally supported on said liquid crystal display unit at said backside end thereof and extending rearwardly into an accommodation opening which is provided in said main body of said apparatus and which receives said display unit when said display unit is in said first position; and including resilient means yieldably urging pivotal movement of said dust shutter in an upward direction within said accommodation opening so that a portion of said dust shutter slidably engages a wall portion of said main body defining a top surface of said accommodation opening.

7. A device of claim 1, wherein said excessive rotation detecting means includes a rotation detecting switch mounted on said liquid crystal display unit and includes a limiting portion held against rotation with said display unit relative to said main body and cooperable with said rotation detecting switch so that said switch is actuated when said display unit is in one of said first and second positions and is deactuated when said display unit is in the other of said first and second positions.

* * * * *